United States Patent [19]

Abatecola

[11] 4,377,306

[45] Mar. 22, 1983

[54] SKI AND SKI POLE TOTE

[76] Inventor: Diana P. Abatecola, 741 Carlow Ct., El Cajon, Calif. 92020

[21] Appl. No.: 295,851

[22] Filed: Aug. 24, 1981

[51] Int. Cl.[3] ..... A63C 11/02

[52] U.S. Cl. ..... 294/147; 280/814; 294/152; 294/162

[58] Field of Search ..... 294/31.2, 137, 138, 294/141, 143, 146–148, 156, 157, 159–163, 165–167; 211/60 SK; 224/917; 280/814

[56] References Cited

U.S. PATENT DOCUMENTS

| | | | |
|---|---|---|---|
| 3,260,430 | 7/1966 | Sandenburgh | 294/147 X |
| 3,268,134 | 8/1966 | Baston et al. | 294/152 |
| 3,780,920 | 12/1973 | Green | 294/147 X |
| 3,935,977 | 2/1976 | Bonnett | 294/147 |
| 3,947,927 | 4/1976 | Rosenthal | 294/147 X |
| 4,120,437 | 10/1978 | Hara | 280/814 |
| 4,294,387 | 10/1981 | Wnek | 294/147 X |

FOREIGN PATENT DOCUMENTS

| | | | |
|---|---|---|---|
| 570654 | 2/1933 | Fed. Rep. of Germany | 294/147 |

*Primary Examiner*—Johnny D. Cherry
*Attorney, Agent, or Firm*—Brown & Martin

[57] ABSTRACT

A flat wrap sheet of flexible material is provided with a pair of flaps adapted to extend through openings in the wrap sheet when it is folded around a pair of skis and a pair of poles. The flaps form retaining enclosures for the skis and poles and fasten in place to snugly retain the skis and poles in position. Hand grip portions extending from the ends of the wrap sheet provide a hand grip when the skis and poles are in the carrying position.

9 Claims, 3 Drawing Figures

SKI AND SKI POLE TOTE

The present invention relates to a tote for carrying skis and ski poles.

BACKGROUND OF THE INVENTION

Skiers find it difficult to transport skis and ski poles to and from the ski slopes which many times are a substantial distance from where their cars may be parked. The length and shape of the skis make them unwieldly to transport. At times skiers place the handle straps of each ski pole over opposite ends of the skis to form a carrier but have found that the skis slip out of position and cause inconvenience.

Various approaches to this problem of carrying skis and ski poles have been patented. They generally fall into the categories of a strap type device or a hard carrier type device. Typical of strap type devices are U.S. Pat. Nos. 4,114,838 and 3,920,166 which involve forming a sling and carrying it over the shoulder. Such strap type devices are not very attractive and appear crude. Skiers are particularly sensitive to appearance of their clothes and equipment and prefer something with a more attractive and refined appearance. Also, shoulder strap type devices are inclined to slip off the shoulder and create annoyance when being used.

The hard carrier type device is represented by U.S. Pat. Nos. 4,190,182; 3,935,977 and 4,059,209. These devices are formed of a hard or non-foldable material and generally do an acceptable job of carrying the skis and poles. However, when not in use, they must be stored some place because they cannot be carried on the person of the skier. The constructions shown in U.S. Pat. Nos. 3,935,977 and 4,059,209 are formed to accommodate a particular ski size and will not secure skis of varying sizes in place with the same degree of retention even though the retaining pockets have resilient linings. These devices cannot be stored on the person of the user but must be locked to ski stands, stored in a locker, or returned to the user's vehicle. The U.S. Pat. No. 4,190,182 provides open top channels for holding the skis and poles in position and relies upon the resilience of the channel side walls to retain the skis. The entire circumference of the skis and poles is not contained within the holder and the skis and poles are more readily pulled out by accident than with a device which completely surrounds the circumference of the skis and poles.

SUMMARY OF THE INVENTION

In view of these problems, it is an object of the present invention to provide a new and improved tote for skis and ski poles which is simple and inexpensive.

It is another object of the present invention to provide a new and improved tote for skis and ski poles which is handy to carry and which readily will accommodate skis and poles of different sizes to hold them securely in position.

It is a further object of the present invention to provide a new and improved tote for skis and ski poles which is attractive in appearance and which can be easily carried on the person of the skier when the skis and poles are removed. These objects are achieved by an exemplary embodiment of the present invention which includes a flat wrap sheet of flexible strong material including a handle strap at each end. Openings are formed in the wrap sheet and two retaining flaps are affixed adjacent one of the openings. The retaining flaps have Velcro strips thereon. The retaining flaps also have Velcro strips adjacent their free ends. The flaps extend through the openings when the wrap sheet is folded and provide a pocket for the poles and a pocket for the skis with the Velcro strips on the respective flaps in engagement to close the pockets to the desired size. The handle straps are positioned adjacent each other to form a convenient hand carrying means when the wrap sheet is folded.

IN THE DRAWINGS

DETAILED DESCRIPTION OF THE INVENTION

Figure 1:
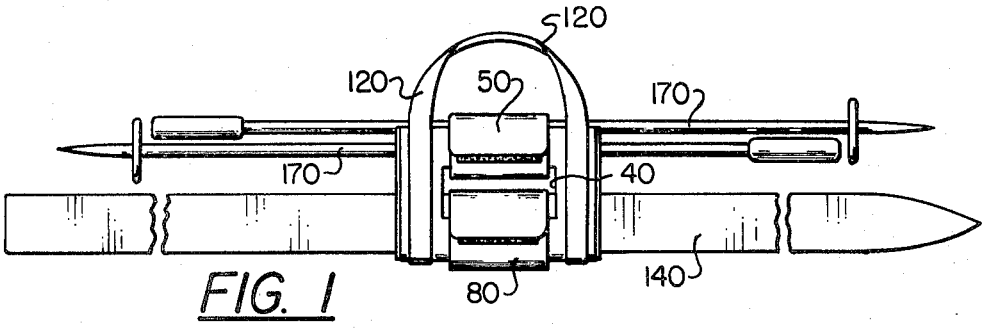
FIG. 1 is a side elevation showing the ski and ski pole tote of the present invention in operative position and containing a pair of skis and a pair of ski poles.
Figure 2:
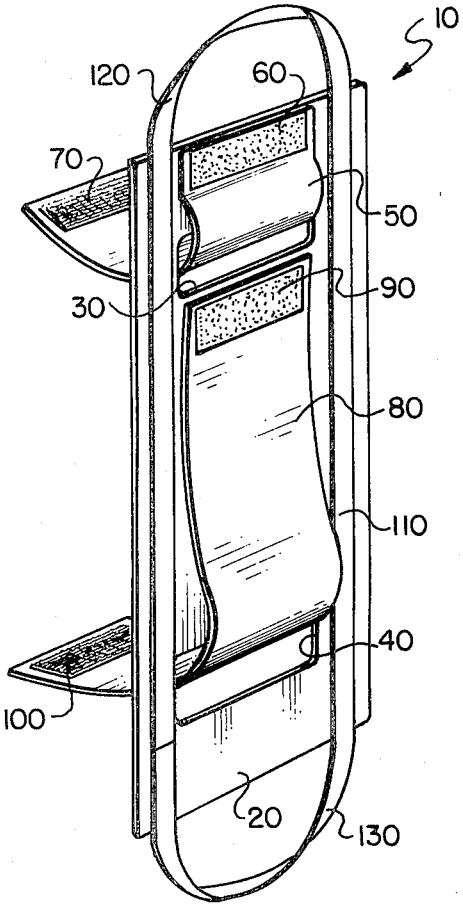
FIG. 2 is a perspective view of the ski and ski pole tote of the present invention prior to inserting skis and ski poles.
Figure 3:
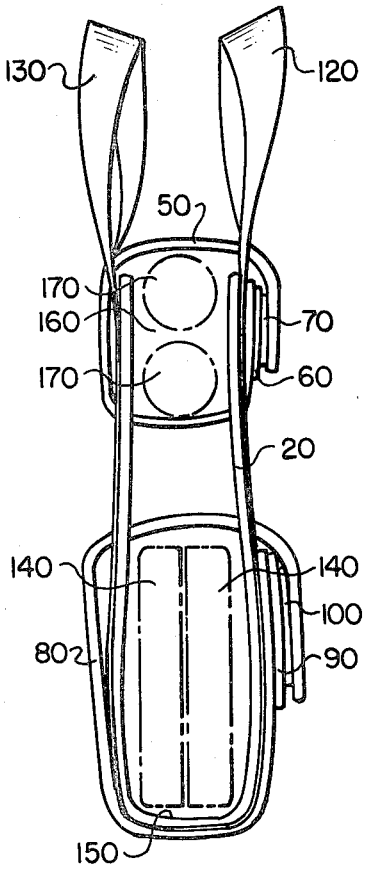
FIG. 3 is an end elevation of the ski and ski pole tote of the present invention in the operative position with skis and ski poles shown in phantom.

Referring to the drawings, a ski and ski pole tote embodying the present invention is designated at 10. The tote is formed of a flat wrap sheet 20 of heavy duty flexible cloth material such as two ply plastic or fabric. In an embodiment which is being used, the material is a two ply colored plastic cloth which is stitched with an attractive border of different color around the edges. The wrap sheet 20 includes an upper opening 30 therein which is stitched around the edges (not shown). A second opening 40 of the same size is provided in the wrap sheet 20 below the first opening 30.

An upper flap 50 is affixed to one side of the wrap sheet 20 by means such as stitching and includes a Velcro strip 60 thereon. The flap 50 has a Velcro strip 70 at its free end on the opposite side of the flap. A lower flap 80, which is longer than the upper flap 50, is affixed to the wrap sheet 20 and includes Velcro strips 90 and 100. A strap 110 is affixed to one surface of wrap sheet 20 and terminates in hand loops 120 and 130.

When the tote is used for carrying skis and ski poles, the wrap sheet 20 is folded in a substantially U-shaped configuration around the skis 140 and the lower flap 80 is inserted through the openings 30 and 40 in the wrap sheet 20 around the top of the skis. The Velcro strips 90 and 100 are engaged when the skis are snuggly in position in the pocket 150 formed by the folded wrap sheet 20. Next, the upper flap 50 is inserted through the openings 30 and 40 in the wrap sheet 20 and forms a pocket 160 which accommodates the ski poles 170. The upper flap 50 is folded over the upper end of the wrap sheet 20 and the ski poles 170, and the Velcro strip 70 is engaged with the Velcro strip 60 to close the pocket 160 with the ski poles firmly engaged in the pocket. The hand portions 120 and 130 are positioned together and form a convenient hand grip.

The poles and skis are quickly and easily removed by disengaging the flaps 50 and 80 and reversing the procedure. The tote 10 can be folded into a lightweight, compact package and carried in the ski jacket.

The construction lends itself to a very attractive package. The edges of the wrap sheet 20 and the flaps 50 and 80 can include a border which is of different color than the wrap sheet and flaps. The color of the Velcro strips can be selected to match the overall color scheme. The result is a very attractive and efficient ski and ski pole tote. The colors for the tote can be selected to match the skiers clothing.

Having thus described my invention, I claim:

1. A ski and ski pole tote comprising:

a wrap sheet of strong, flexible material having a pair of spaced apart openings therein;

a first flap on said wrap sheet adapted to extend through the openings in said wrap sheet when said wrap sheet is folded to a substantially U-shaped configuration with said openings aligned for forming a pocket for seating said skis;

first fastening means on said first flap to fasten it to said wrap sheet when skis are placed within said pocket;

a second flap on said wrap sheet near one end thereof and adapted to extend through said openings when said wrap sheet is folded, and second flap forming a pocket for seating the ski poles;

second fastening means on said second flap to fasten it to said wrap sheet when ski poles are placed within said pocket; and hand carrying means on the ends of said wrap sheet which form a hand grip when said wrap sheet is folded.

2. A ski and ski pole tote according to claim 1 wherein said first flap and fastening means accommodate skis of different thicknesses.

3. A ski and ski pole tote according to claim 2 wherein said second flap and fastening means accommodate poles of different diameters.

4. A ski and ski pole tote according to claim 3 wherein the fastening means on said first and second flaps comprise Velcro strips adjacent the ends of each of said flaps.

5. A ski and ski pole tote according to claim 4 wherein the hand carrying means includes a strap positioned around one side of said wrap sheet and forming handle loops extending from the ends of said wrap sheet.

6. A ski and ski pole tote according to claim 5 wherein the components of said tote are affixed to each other by stitching and all edge portions are stitched.

7. A ski and ski pole tote according to claim 1 wherein said wrap sheet and flaps are formed of multiple ply material.

8. A ski and ski pole tote according to claim 7 wherein said wrap sheet and flaps are formed from two ply material.

9. A ski and ski pole tote according to claim 1 wherein a first opening is located near the bottom end of said wrap sheet and a second opening is located near the top of said wrap sheet; and said first flap is affixed to said wrap sheet below said second opening and said second flap is affixed to said wrap sheet above said second opening, said flaps being affixed to the same side of said wrap sheet.

* * * * *